United States Patent [19]

Tully

[11] 3,958,375

[45] May 25, 1976

[54] PREFABRICATED HYPERBOLIC PARABOLOID ROOF

[76] Inventor: Daniel F. Tully, 110 Ellis Farm Lane, Melrose, Mass. 02176

[22] Filed: Apr. 1, 1974

[21] Appl. No.: 456,522

[52] U.S. Cl. ..... 52/80; 52/584

[51] Int. Cl.[2] ..... E04B 1/32

[58] Field of Search ..... 52/80, 81, 753 C, 227, 52/588, 584

[56] References Cited

UNITED STATES PATENTS

| | | | |
|---|---|---|---|
| 291,202 | 1/1884 | Koch | 52/753 C |
| 571,042 | 11/1896 | Edgaist | 52/753 C |
| 2,795,305 | 6/1957 | Bagge | 52/584 |
| 3,094,812 | 6/1963 | Peeler | 52/80 |
| 3,186,128 | 6/1965 | Charles | 52/80 |
| 3,206,895 | 9/1965 | De Ridder | 52/80 |
| 3,339,783 | 9/1967 | Gorman | 52/406 |
| 3,479,784 | 11/1969 | Massagli | 52/588 |
| 3,653,166 | 4/1972 | Kirschen | 52/80 |
| 3,729,876 | 5/1973 | Kolozsvary | 52/86 |
| 3,807,105 | 4/1974 | Rudkin | 52/80 |

FOREIGN PATENTS OR APPLICATIONS

| | | | |
|---|---|---|---|
| 1,019,362 | 2/1966 | United Kingdom | 52/80 |
| 125,089 | 5/1949 | Sweden | 52/584 |

*Primary Examiner*—Ernest R. Purser
*Assistant Examiner*—Henry Raduazo
*Attorney, Agent, or Firm*—Joseph Zallen

[57] ABSTRACT

A hyperbolic paraboloid roof shell section made in prefabricated portions each of which has a joining edge parallel to the joining edge of another prefabricated portion and is adapted to extend between two beams of the roof frame. The joining edges of the adjacent portions have fastener means adjacent to the joining edges which provide tensile and shear strength.

10 Claims, 20 Drawing Figures

PREFABRICATED HYPERBOLIC PARABOLOID ROOF

CROSS-REFERENCE

This is a continuation-in-part of my copending prior application, Ser. No. 255,620, filed May 22, 1972 and having the same title.

BACKGROUND OF INVENTION

This invention relates to a hyperbolic paraboloid roof structure which can be assembled on the site from prefabricated sections, generally few in number.

A hyperbolic paraboloid roof is a configuration which has esthetic, structural and economic advantages for many purposes as, for example, inexpensive, attractive, large area structures free of intermediate columns, as, for example, hangers, auditoriums and gymnasiums. It is believed that the most pertinent prior art on this subject is found in United States Patent Office Classes 52 and 287, with particular reference to subclasses 80, 81, 227 and 584 of Class 52, and subclass 2092.5 of Class 287.

Prior to the present invention, hyperbolic paraboloid roof structures were customarily assembled piece by piece on the site by cutting, fitting and assembling the various portions of the roof. Thus, Peeler, U.S. Pat. No. 3,094,812, describes a precast, concrete element which in itself is flat and is assembled in multiples on steel rods or cables running through the elements both longitudinally and transversely to form a support network. Charles, U.S. Pat. No. 3,186,128, shows the construction of a hyperbolic paraboloid roof in a panel by panel construction of small sheet metal panels attached to one another, edge to edge, with waterproof joints, requiring a frame. British Pat. No. 1,019,362 (1966) describes a hyperbolic paraboloid roof which is assembled by having one layer of relatively small panels running in one direction followed by another layer of panels running in another direction. Hyperbolic paraboloid roofs have also been made by steel framing with reinforced concrete and by piece by piece assembly of wooden components.

One object of the present invention is to provide a novel hyperbolic paraboloid roof shell and a method of fabrication which permits the support portions to be prefabricated and then readily assembled on site.

A further object of this invention is to provide a hyperbolic paraboloid roof which can be built far more rapidly and at a much lower cost then previously described roofs of this sort.

Other objects and advantages of this invention will be apparent from the description and claims which follow taken together with the appended drawings.

SUMMARY OF INVENTION

The invention can be best understood by reference to a description of the principal sequence of steps for the erection of the building. The first step is the construction of concrete foundation walls and abutments. At each low working point are then installed edge beam connections at the proper location. After work points in space at proper locations and elevations have been established by the engineer, perimeter edge beams are then installed, said beams being connected to the foundation and to a portion of another beam extending from the foundation. Interior edge beams are then connected and installed. This complex of connected beams comprises the frame of the roof. The present invention is primarily concerned with the fabrication and installation of the roof sections shaped to fit and be supported by these beams. Such roof sections, are hereinafter referred to as the roof shell sections. After the roof shell sections have been installed, as hereinafter explained, a variety of finish and cover materials can be installed by conventional or previously described methods.

The method for forming and installing a roof section on a polygon formed by the beams of the frame comprises first forming the whole roof shell section in the factory under controlled conditions. Depending on the materials which are used, such a section can of course vary widely but would typically cover an area of from about 1,000 to 6,000 square feet. The materials which can be used in this invention can include concrete and other cementitious materials, but preferably include wood laminations and laminations of glass fibers reinforced with resins such as polyester resin. Where a material such as wood is used, the entire section is preformed in the appropriate geometry and then sliced to form the portions. Where a flowable material such as glass fibers in resin are used, individual molds can be made for each portion and can preferably include an edge flange which overlaps for joining.

After the portions of the roof shell sections are delivered to the site they are assembled and installed on the corresponding frame opening by means of fastener means adjacent to the joining edges. For wood, mechanical fasteners provide tensile and shear strength. For resinous glass fibers, adhesive means can be used. Except for these joining edge fastening means and the actual connections of the ends of the pieces onto the beams to which they attach, no other fastening means are required to hold and maintain the piece together as a structurally sound entity. Thus, in contrast with an example of the prior art in which steel rods or cables are required both longitudinally and transversely between support beams, the present invention does not require any fastening means to extend completely through the prefabricated portion between two beams.

Where a material such as laminated wood, e.g. plywood, is used in fabricating the roof shell section, it is preferred to use at least three layers of the material. One layer runs in a different direction than other layers. It is also preferred that a specially constructed form be used under which to assemble the roof shell section. Circular or rectangular slots are cut in at spaced intervals for the construction connector, as well as holes around the perimeter for fastening. In such wood construction, it is preferred to use both a construction joint tensile connector as well as an alignment shear connector. The construction joint tensile connector is typically composed of a pair of semi-circular steel plates ties together by a bolt and nut. The alignment shear connector typically comprises a base plate having a square punched hole in the center, a carriage bolt having a registering square shoulder, a top plate with a slot, a washer and a nut. By use of this combination of connectors the various prefabricated portions can be adjusted to fit properly and attach securely to the beams which form the perimeter of the roof shell section. The connectors establish interaction between the portions of the roof shell section as through the entire shell were fabricated as a whole.

In addition to such connectors, other mechanical fasteners can be used if they provide appropriate tensile and shear strength at the joint. The actual attachment of the prefabricated sections to the beams which support them are typically bolts, such as lag bolts, but can also be other fasteners or equivalents.

In another embodiment of this invention, a laminate utilizing principally glass fibers which are reinforced with polyester resin is used in place of wood laminates. In one preferred form, the primary structure, namely the section of the roof shell, is formed by a sandwich in which the top and bottom layers are glass fibers impregnated with resin and the intermediate layer is a porous, insulating material, as for example, polyurethane in porous form. Where the ends of the prefabricated portions are to be attached to the roof beams or to each other, the porous layer is omitted. Also, stiffening ribs of glass fibers impregnated with resin are preferably sandwiched between the outer and inner surfaces at various intervals depending upon the individual requirements of the particular span and load, with the porous material filling in the spaces.

It should be noted that in most respects these prefabricated portions of layers of glass fibers impregnated with resin and filled with an insulating material are similar in general design and arrangement and geometry of attachment to the wood version. In this embodiment, as well as the wood version, the the connections are made adjacent to the edges and there are no requirements of any other supports extending all the way through. In both cases, all the portions which are to be assembled extend between two beams and have at least one joining edge parallel to the joining edges of another portion.

One significant advantage of the resin-impregnated glass fiber laminate portions is that they combine structure, insulation and waterproofing in a single operation. Prior art methods and structures required three separate and expensive operations for structure, insulation and waterproofing. Further, these resin-impregnated glass fiber laminate portions have a weight, on the average, of from 1/50 to 1/5 the weight of equivalent, rigid prior art structures. Thus, for example, for a 150 foot span has a weight in the order of 120 pounds per square foot, a wood frame and roof shell in accordance with this invention in the order of 15 pounds per square foot, and resin-impregnated glass fiber laminate in accordance with this invention in the order of 6 pounds per square foot. These weights are with reference to the entire weight above the foundation abutments.

Because of the substantial decrease in weight achieved by the use of resin-impregnated glass fiber laminates in accordance with this invention the resulting prefabricated portions are much easier to handle, ship and erect. Further, since the total weight of the structure is substantially reduced, it is possible to erect buildings with prefabricated hyperbolic paraboloid roofs on soils which were otherwise of insufficient structural quality to support buildings constructed in accordance with prior art.

It should be noted that while the following examples are illustrative of the invention, that this invention is applicable to structures having different beam arrangements than those illustrated, as for example, arrangements which permit expansion in one direction.

SPECIFIC EXAMPLES OF INVENTION

Figure 1:
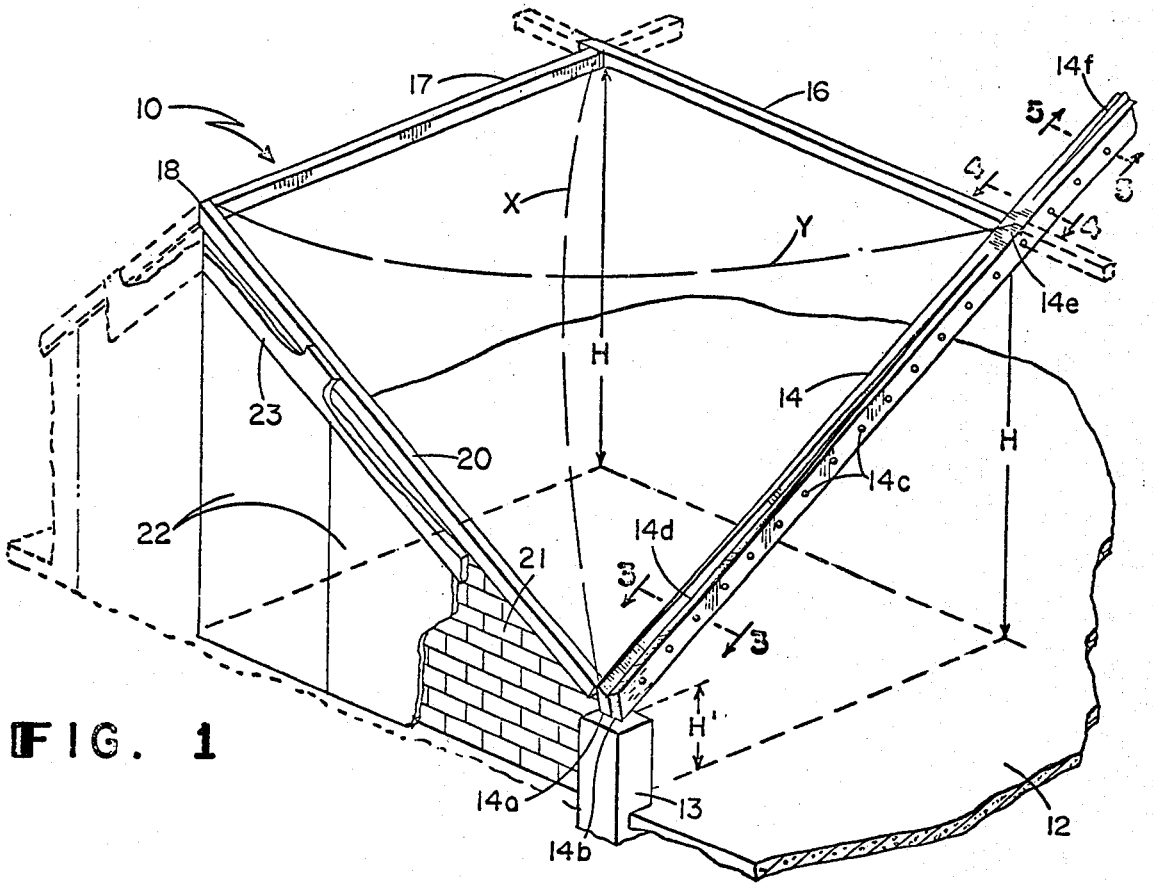
FIG. 1 shows beams attached to a foundation and defining the area for a roof shell section.
Figures 3, 4, 5:
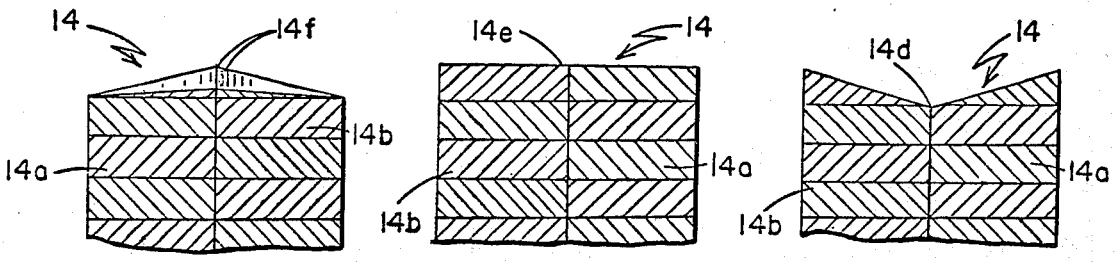
FIG. 3 is a transverse section along line 3—3 of FIG. 1 showing a typical beam construction.
FIG. 4 is a view along line 4—4 of FIG. 1 showing another portion of the beam.
FIG. 5 is a section along line 5—5 of FIG. 1 showing another portion of the beam.
Figure 2:
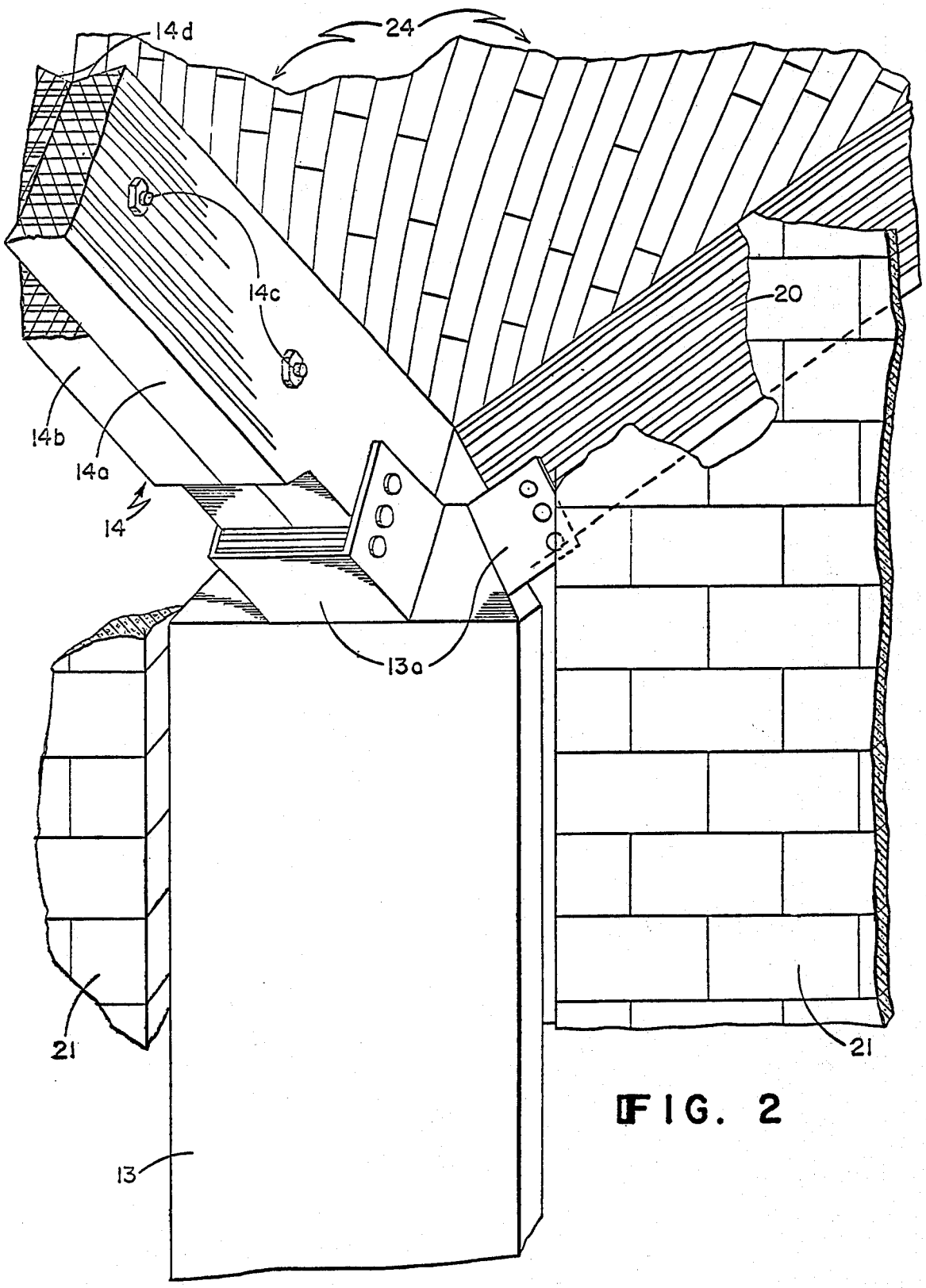
FIG. 2 is an interior view at the bottom of FIG. 1 after the roof shell section has been attached to the frame.

Referring now to the embodiment illustrated in FIGS. 1–12 drawings, there is shown therein in FIG. 1 a frame 10 for a roof shell section. The frame comprises beams 14, 16, 17, and 20. Beams 14 and 20 are attached to abutment 13 which protrudes from floor 12. The beams are made of various laminated layers of wood in various forms. Beam 14, for example, has a trough or groove top portion 14(*d*), a flat top portion 14(*e*) and a ridge top portion 14(*f*). The beam 14 is attached to the abutment 13, as shown in FIG. 2, by means of metal brackets 13(*a*) and also has an array of spaced bolts 14(*c*).

Figure 6:
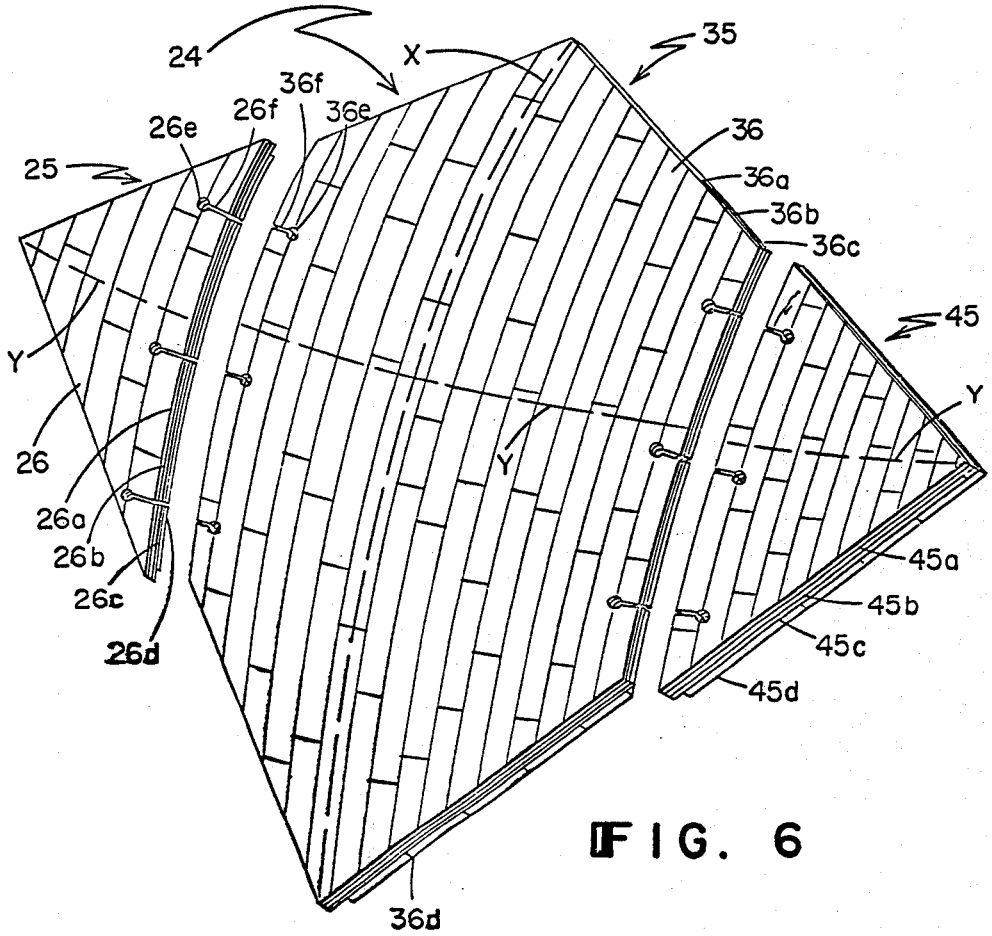
FIG. 6 is an exploded view of the prefabricated roof shell section shown cut into three components.

The prefabricated roof shell components illustrated in FIG. 6 comprise three layers 36(*a*), 36(*b*) and 36(*c*) of wood lamination on roof boards 36(*d*) in component 35 and corresponding layers 26(*a–d*) and 45(*a–d*) in components 25 and 45. At regular intervals on the edges of the cut portions are slots 26(*d–f*), 36(*e–f*), etc. for accommodation of the construction joint connector 70. The construction joint connector 70 comprises a bolt 73 tied on either end by nut 72 and 74 to semicylindrical shells 71 and 75 which register with the cylinder openings 26(*e*) and 36(*e*) and the slots 26(*f*)

and 36(*f*) at the junction between components 25 and 35.

Figure 8:
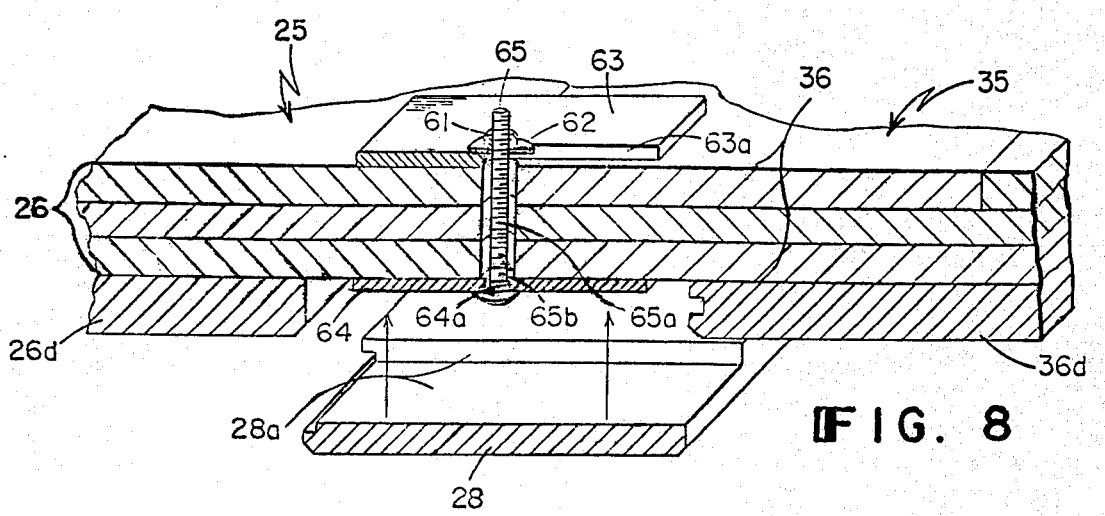
FIG. 8 is an enlarged partial section view showing an alignment shear connector.
Figure 11:
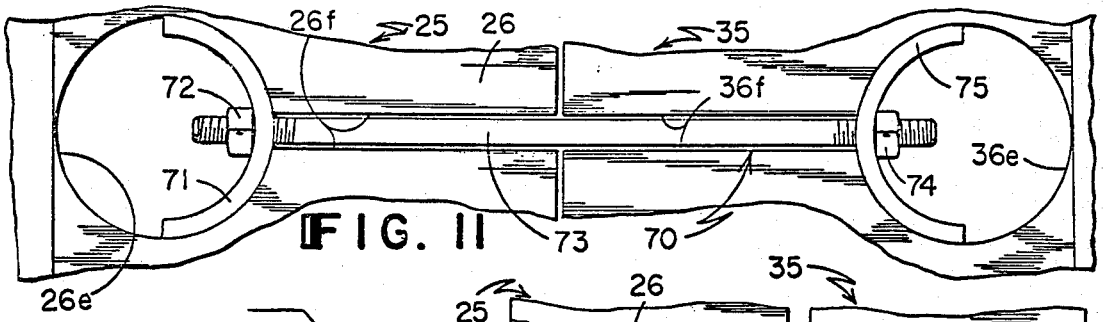
FIG. 11 is a similar view as in FIG. 10 but showing the construction joint connector in installed assembled condition.
Figure 10:
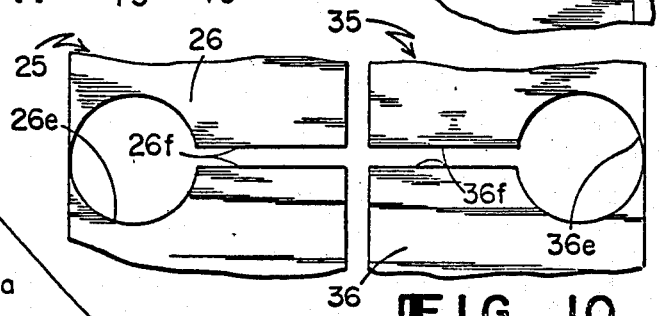
FIG. 10 is an enlarged partial top view of adjacent portions of two roof shell components showing the cutouts for the construction joint connectors.
Figure 9:
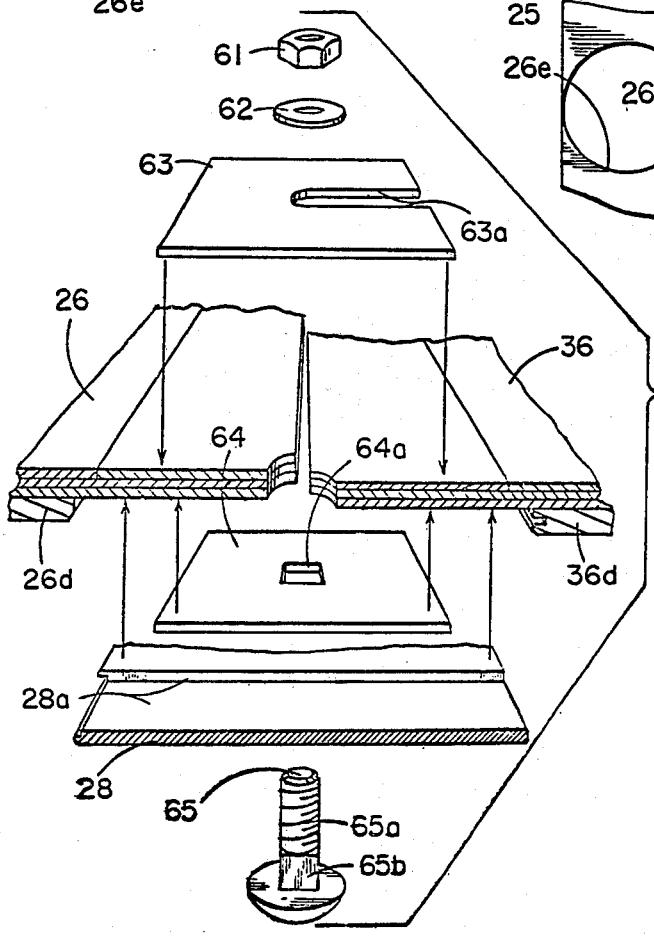
FIG. 9 is an exploded view of an alignment shear connector.
Figure 12:
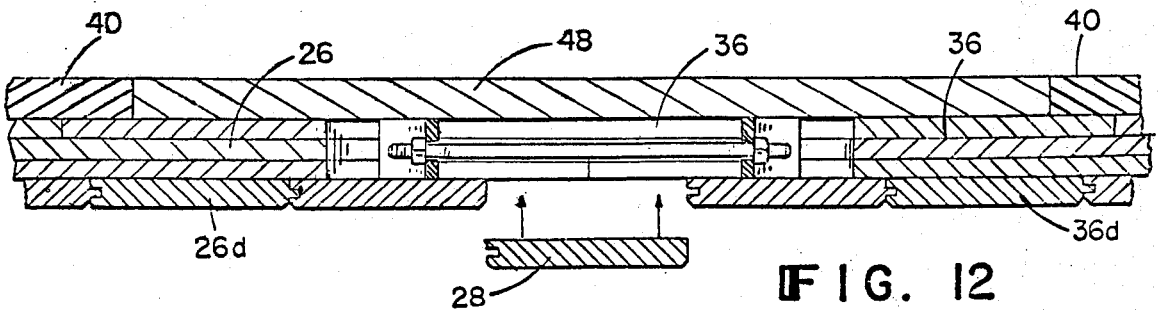
FIG. 12 is a vertical section of a construction joint connector in assembled installed condition.

The alignment shear connectors, illustrated in FIGS. 8 and 9 are vertical bolts used on the abutting surfaces of the components 25 and 35 and comprise vertical bolt 65, plate 64 with a square central orifice, plate 63 with a slot 63(*a*) and conjunction with washer 62 and nut 61.

Figure 7:
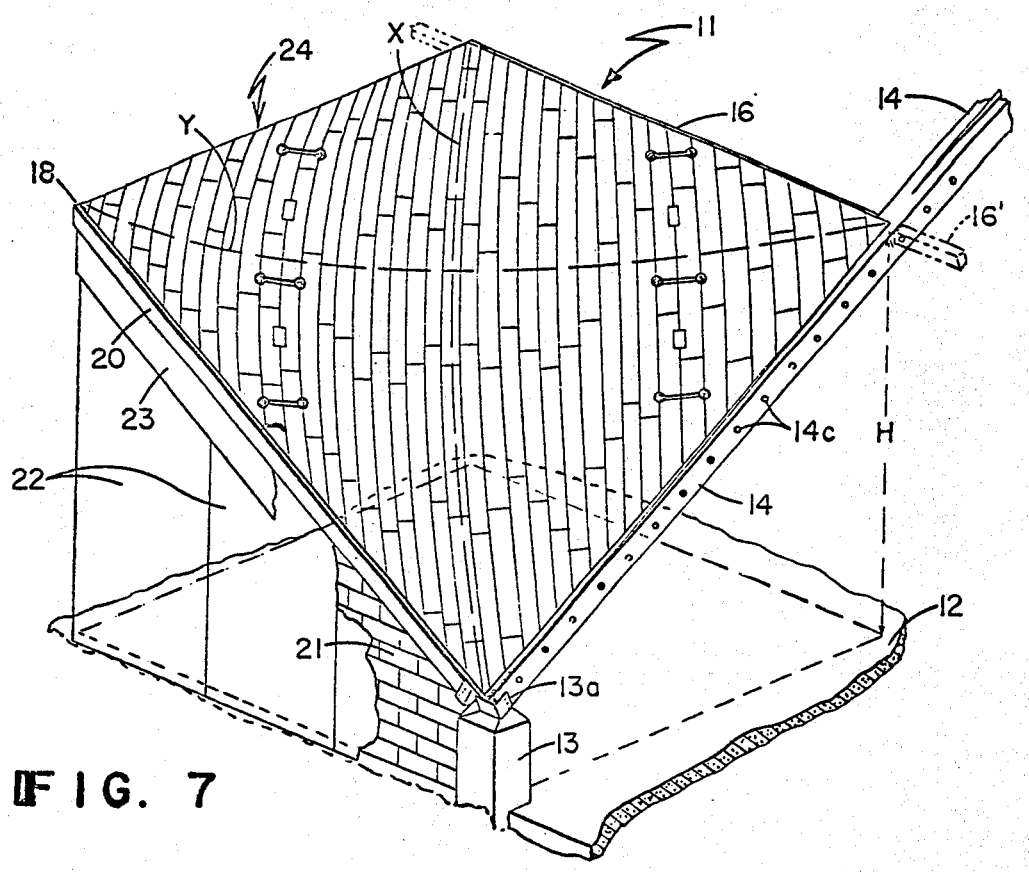
FIG. 7 is an exterior view as in FIG. 1 but showing the roof shell section in position on the beams.

Referring now to FIGS. 1, 6, and 7, the hyperbolic paraboloid shown therein is defined by the translation of a convex parabola X along a concave parabola Y perpendicular to it. A preferred method is described below for construction of the form for the roof shell component and for fabricating the component.

The construction of the form can be accomplished, having reference to FIG. 1 for the outline, by first dividing the lengths of members 20, 16, 17 and 14 into an equal number of spaces such that the dividend by the common devisor does not exceed a particular maximum, as for example, 2 feet. Starting at about point 14(*e*), move along member 16 enumerating the divisions sequentially 1 through *n*, thence along member 20 starting at 14(*a*), enumerate the divisions 1 through *n*.

The division should then be connected with straight lines between the corresponding numbers, these lines being designated as generators. Then edge members of laminated lumber should be erected to conform to the outline of members 16, 17, 20 and 14. Along the lines of the generators, framing lumber should be erected which have edges co-linear with the generators. The alignment of this framing lumber should be verified by developing generators along 17, 14 as for 16, 20. The form is completed by placing covering sheets, such as plywood, across the generators to conform to the shape and follow the geometry.

In using the form to fabricate the roof shell component, the arc Y is divided into thirds and a plumb is run from the third point of the arc Y to the shell form. Two parallel arcs are drawn, each parallel to arc X. Along these arc lines are set roof boards coated with Teflon or other non-sticking material.

Beginning along arc X, lay and temporarily secure the roof boards 26(*d*) – 36(*d*) and 45(*d*) to the left and right of arc X and parallel to it across the entire surface. It is preferable to allow no but joints to occur nearer than about two feet on adjacent boards and four feet on the average. It is also preferred that double headed staging nails be used to tack the boards in position.

On this roof board support position, staple and glue three layers of plywood. Thus, the first full layer is placed across the entire surface using glue and fasteners, such as chisel staples at predetermined centers, e.g. 3 inches. The joints should be staggered, and preferably stapling should be done out from the center. The second plywood layer pieces should be perpendicular to the arcs of the roof boards, staggered about 50% from the first layer and glued and stapled. The third plywood layer should be perpendicular to the first two lay ers or parallel to the roof boards and also glued and stapled.

After the roof component is sliced as in FIG. 6, and the edges dressed, plugs and slots 26(*e–f*), 36(*e–f*) and 45(*e–f*) are cut out and routed as well as the edge orifices 65(*d*) to accommodate the connector 65. Then holes are drilled for lag bolts around the perimeter of the shell at specified intervals.

Once these steps have been accomplished, the shell portions can be removed from the form and stacked for shipment. In general, it is best to accumulate all the roof shell components needed for the building before beginning erection.

As illustrated in FIG. 7, it is preferred that when a laminated wood roof shell section is used the prefabricated portions be arranged so that the X-axis of each portion is at an angle of approximately 45 degrees with its supporting beams, because the wood structure is essentially anisotropic. However, the resin-impregnated glass fiber laminate prefabricated portions being isotropic can be used at a variety of angles with their supporting beams, it thus being possible to have the joining edges at a variety of angles with the supporting beams.

Figure 13:
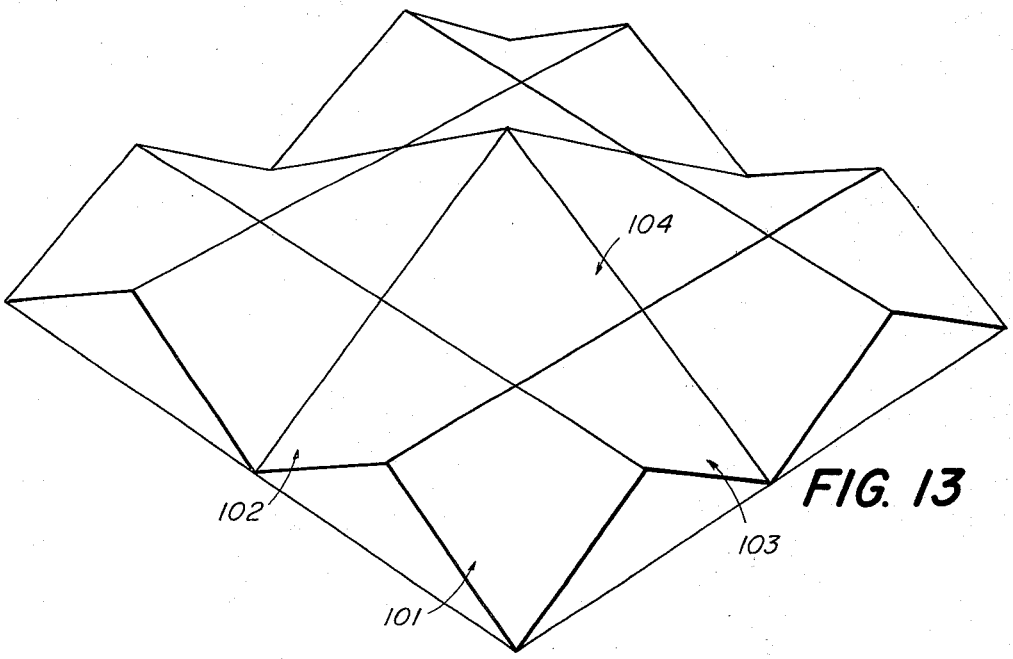
FIG. 13 is a perspective view of a roof shell showing the arrangements of the roof shell sections. This is a typical arrangement of roof shell sections whether made by means of this invention or otherwise. A particular roof shell section can be made by use of the embodiment illustrated in the preceeding FIGS. 1–12 or by the embodiment illustrated in the succeeding FIGS. 14–19. The numerals in this FIG. 13 refer to the embodiment illustrated in the succeeding figures.

Installation of the roof shell sections, as made in accordance with this invention, is performed on a previously erected frame made of beams. FIG. 13 illustrates an examle of a hyperbolic paraboloid roof shell showing the various sections which make up the entire roof shell. The general manner would be similar whether the material used was wood or resin impregnated glass fibers. Typical roof shell sections are designated by Numerals 101, 102, 103 and 104. In the embodiment to be described below, it is assumed that this roof shell is constructed from resin impregnated glass fibers and Section 101 is illlustrated in detail.

Referring now to the embodiment illustrated in FIGS. 14–19, the embodiment illustrated therein is shaped in a generally similar geometric manner as in the embodiment illustrated in FIGS. 1–12, but is formed by molding each portion separately.

Roof shell section 101 comprises outer, relatively rigid resin-impregnated glass fiber layers 114 and 115. Spaced between these layers is a convoluted stiffening rib 116 also formed from resin impregnated glass fibers. Section 101 has lateral extensions 118–119 which are co-extensive with layer 114 and are adjacent thereto so as to form a convenient means for attachment of one portion of a roof shell section to a beam or to another portion (e.g., 112 to 113). In the embodiment illustrated herein, there are four portions, 110, 111, 112 and 113, to the parallel joining edges, with each portion extending between and attached to opposing beams 16 and 20.

The resin impregnated glass fiber outer layers 114 and 115 and rib 116 form pockets which are filled with a suitable insulating or reinforcing material 117 such as expanded polyurethane of a density preferably in the magnitude of two pounds per cubic foot. With a thickness of about two inches, wherein the reinforced glass fibers and the outer layers and rib are about 1/8 inch in thickness, the resultant product exceeds a tensile strength of 16,000 pounds per square inch and an elastic module of 1,600,000 cubic inches. With such a structure, spans can be obtained of up to 40 feet. By increasing the thickness linearly with respect to the desired span, the product can be made to span about 60 feet per portion or about 250 feet per roof shell section.

It should be noted roof shell portions 110, 111, 112 and 113 of this embodiment are integral and unitary. they follow the desired geometry but can be made by assembly of components, molding or a combination thereof. Thus, for example, a suitable mold for the particular portion has the appropriate dimensions of receiving the appropriate thickness of flowable, mold curing mixture of glass fibers and resin to form layer 114 with extension 119 adjacent portion 118 and the portions of the rib 116 which are adjacent to layer 114. Then appropriate sized, preformed, air-containing polyurethane blocks are placed on the mixture. Further mixture is then poured so as to encapsulate the blocks and form the opposite layer 115 and the remainder of the rib 116.

Figure 16:
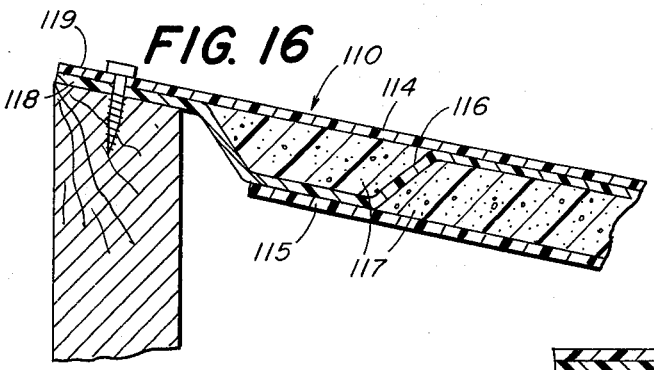
FIG. 16 is a section along line 16—16 of FIG. 16.
Figure 17:
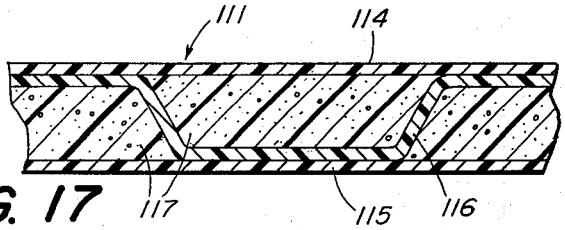
FIG. 17 is a section along line 17—17 of FIG. 15.
Figure 18:
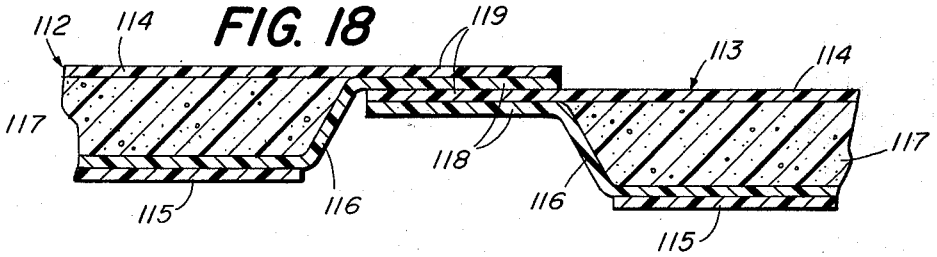
FIG. 18 is a section along line 18—18 of FIG. 15.
Figure 19:
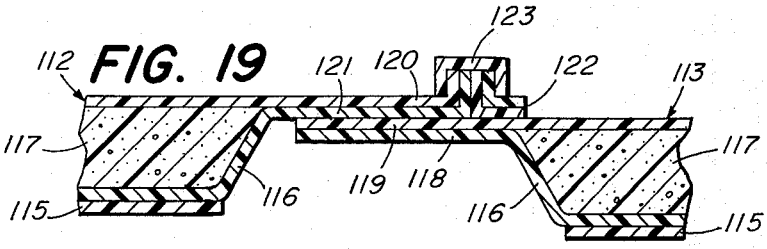
FIG. 19 is a section along line 19—19 of FIG. 15.
Figure 14:
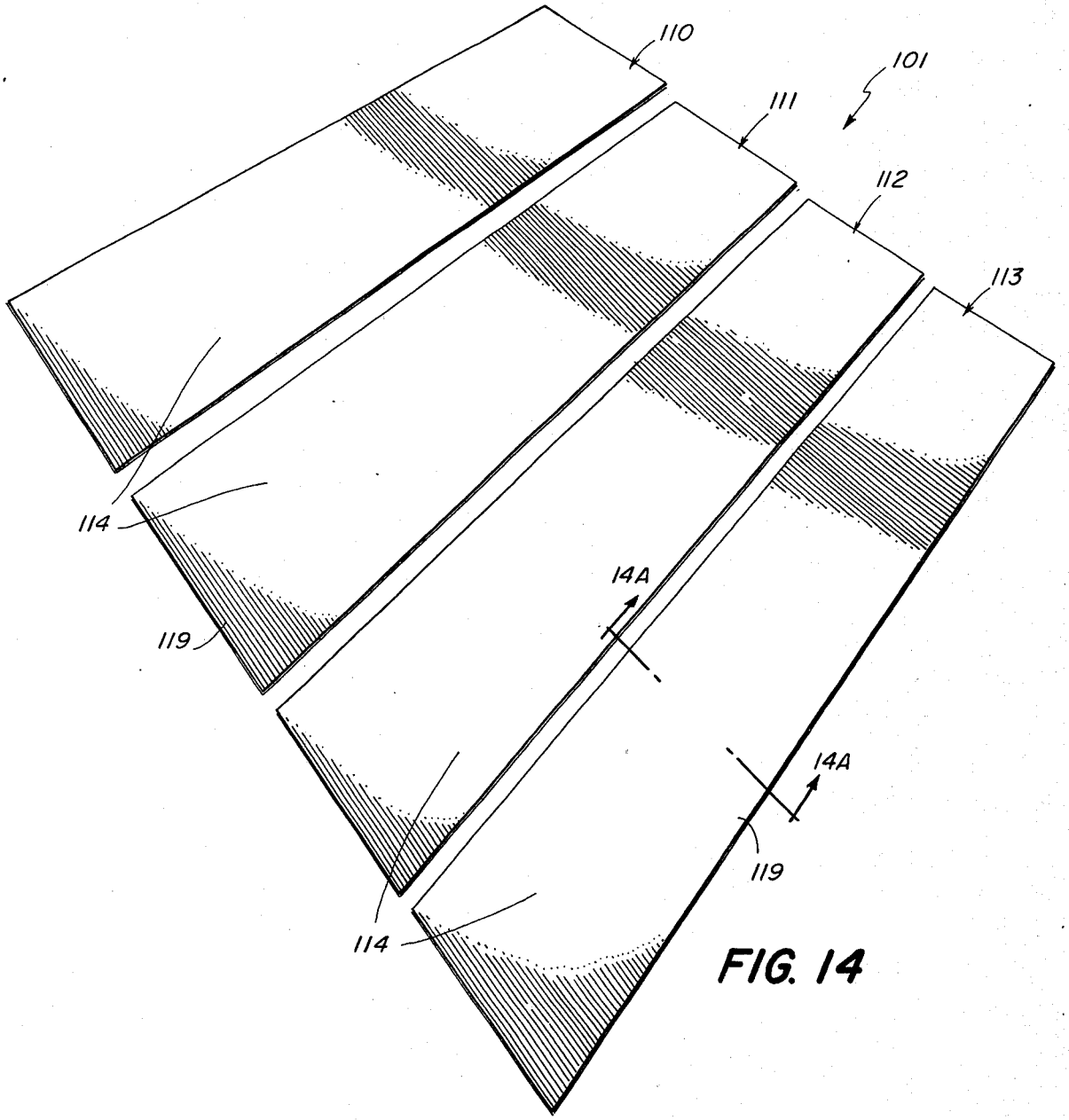
FIG. 14 is an exploded view of another embodiment of this invention showing a prefabricated roof shell section cut into four components.
Figure 14A:
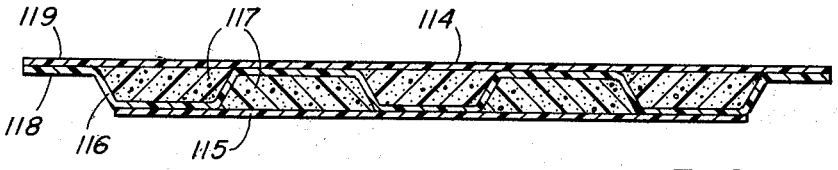
FIG. 14A is a section along line 14A—14A of FIG. 14.
Figure 15:
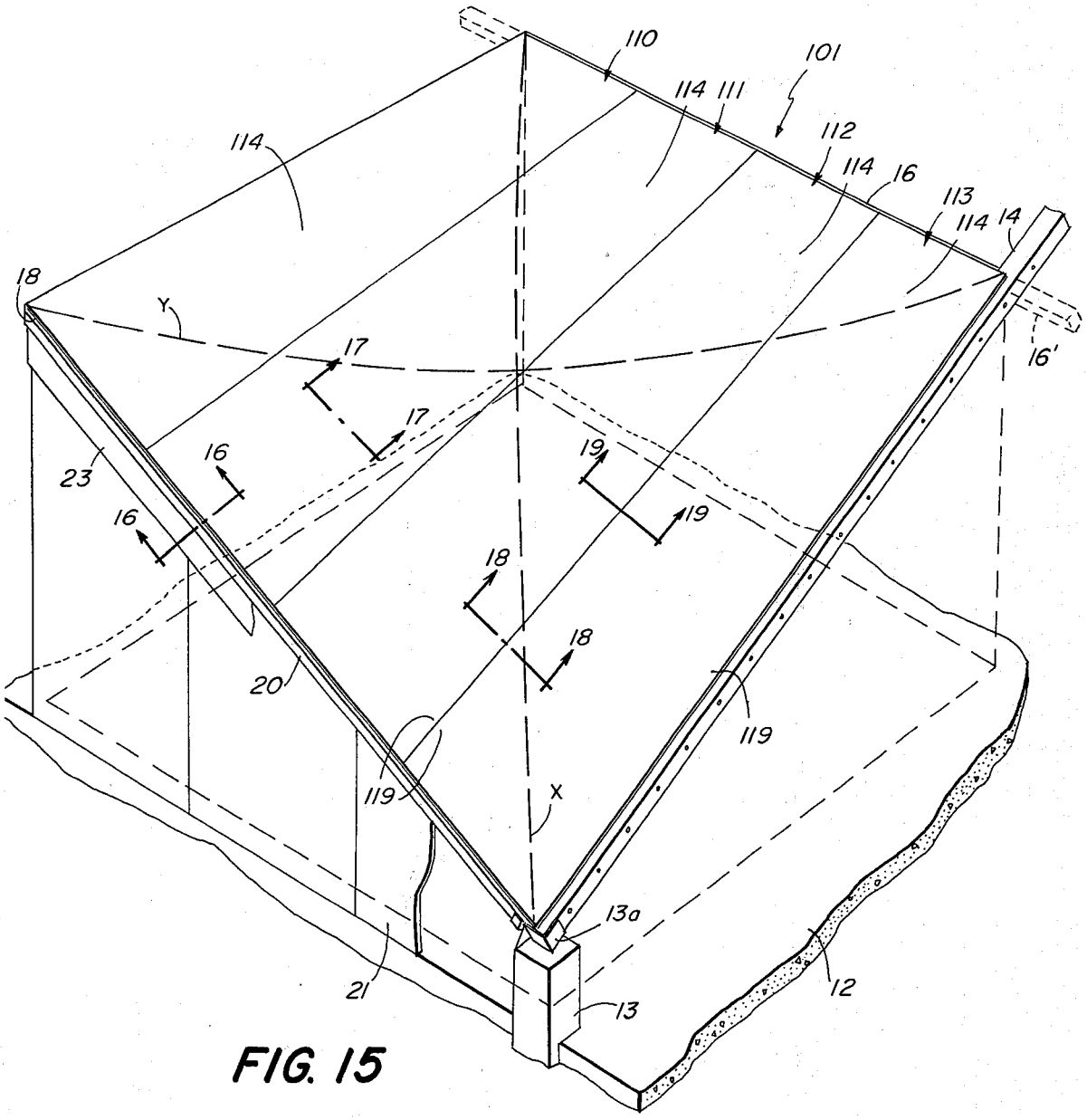
FIG. 15 is an enlarged single roof shell section shown in position on beams and footing.

As shown in FIG. 16, 18 and 19, the joining edge extension 118–119 can be used to attach to a support beam or to the joining edge plank of another portion. In the latter case, it is preferred practice to apply the appropriate adhesive and then hold the edges together temporarily with clamps which are later removed.

The joining edge configuration shown in FIG. 19 is slightly different and is a variation. The extension 121–125 has an upward extension and a cap 123.

As compared with wood, the cost of this particular embodiment made of impregnated glass fibers, filled with expanded polyurethane, is considerably less. Further, because of the decrease in weight, the same beam structure can support a greater roof surface area. At the present, the use of wood gives a limitation of about 130 feet for a maximum span. Further, the use of wood regulates insulation and waterproofing. The expanded polyurethane obviates the need of insulation.

I claim:

1. In a building, a frame (10) in combination with a hyperbolic paraboloid roof shell section (11); said frame (10) comprising four boundary beams (14, 16, 17 and 20); said roof shell section being structurally adequate and attached to said beams and defined by the translation of a convex parabola along a concave parabola perpendicular to it to form a hyperbolic paraboloid; said roof shell section comprising a single layer of a plurality of prefabricated structural components, (25, 35 and 45), each made of laminated wood; each said prefabricated component having a joining edge parallel to the joining edge of another said component, all said components being oriented in the same direction; each said joining edge extending diagonally between two adajecent said beams; said components being attached to one another along their joining edges by fastening means which provide tensile and shear strength for the joint; said fastening means being located adjacent said joining edges and being sufficient to provide tensile and shear strength for the joint without any supplemental or additional supporting means so as to provide a structurally adequate joint.

2. The combination of claim 1 wherein said prefabricted portions are generally uniform in thickness.

3. The combination of claim 1 wherein said beams are supported by abutments.

4. The combination of claim 3 wherein two adjacent beams are supported on one abutment.

5. The combination of claim 1 wherein the fastening means comprises mechanical tensile and shear connectors, each of said connectors being characterized as including a threaded member acting in conjunction with a pair of retaining plates; the threaded member of such tensile connector being generally horizontal and the threaded member of said shear connector being generally vertical.

6. In a building, a frame (10) in combination with a hyperbolic paraboloid roof shell section (11); said frame (10) comprising four boundary beams (14, 16, 17 and 20); said roof shell section being structurally adequate and attached to said beams and defined by the translation of a convex parabola along a concave parabola perpendicular to it to form a hyperbolic paraboloid; said roof shell section comprising a single layer of a plurality of prefabricated structural components, (25, 35, and 45), each made of a laminate of resin-impregnated glass fibers containing an insulating filler, each said prefabricated component having a joining edge parallel to the joining edge of another said component, all said components being oriented in the same direction; each said joining edge extending diagonally between two adjacent said beams; said components being attached to one another along their joining edges by fastening means which provide tensile and shear strength for the joint; said fastening means being located adjacent said joining edges and being sufficient to provide tensile and shear strength for the joint without any supplemental or additional supporting means so as to provide a structurally adequate joint.

7. The combination of claim 6 wherein each component comprises outer layers of resin-impregnated glass fibers enclosing a convoluted stiffening rib or resin-impregnated glass fibers and has extensions which form the joining edge.

8. The combination of claim 7 wherein the spaces between the outer layers and rib are filled with an insulating filler.

9. The combination of claim 6 wherein said beams are supported by abutment.

10. The combination of claim 9 wherein two adjacent beams are supported on one abutment.

* * * * *